United States Patent [19]

Okuyama et al.

[11] 4,433,318

[45] Feb. 21, 1984

[54] DEFLECTION YOKE FOR A PICTURE TUBE OF A PROJECTION COLOR TELEVISION RECEIVER SET

[75] Inventors: Nobutaka Okuyama; Toshiharu Shimizu; Yoshikazu Naito, all of Yokohama, Japan

[73] Assignee: Hitachi, Ltd., Tokyo, Japan

[21] Appl. No.: 391,983

[22] Filed: Jun. 25, 1982

[30] Foreign Application Priority Data

Jun. 26, 1981 [JP] Japan ..... 56-98221
Oct. 26, 1981 [JP] Japan ..... 56-170018

[51] Int. Cl.[3] ..... H01F 5/00
[52] U.S. Cl. ..... 335/213; 335/210; 313/421; 313/426
[58] Field of Search ..... 335/210, 212, 213; 313/421, 426

[56] References Cited

U.S. PATENT DOCUMENTS 4,088,930 5/1978 Barten ..... 335/213 X
4,238,751 12/1980 Shimoma ..... 335/213
4,310,799 1/1982 Hutchison et al. ..... 335/213 X

*Primary Examiner*—George Harris
*Attorney, Agent, or Firm*—Antonelli, Terry & Wands

[57] ABSTRACT

A deflection yoke for a picture tube of a projection color television receiver set has a solenoid-shaped auxiliary coil arranged adjacent to a core of the deflection yoke with a center axis of the auxiliary coil being aligned to a center axis of the deflection yoke. A vertical deflection current or a horizontal deflection current is supplied to the auxiliary coil. An electron beam is deflected by a magnetic field generated by the current of the auxiliary coil so that a raster formed on a face plate of the picture tube is deformed. The raster is deformed to such an extent that it has a correct shape when it is projected on a screen.

10 Claims, 20 Drawing Figures

DEFLECTION YOKE FOR A PICTURE TUBE OF A PROJECTION COLOR TELEVISION RECEIVER SET

BACKGROUND OF THE INVENTION

1. Field of the Invention

The present invention relates to a deflection yoke for a picture tube of a projection color television receiver set, and more particularly to a deflection yoke for a picture tube for obliquely projecting light to a screen of a projection color television receiver set which has three picture tubes for emitting red light, green light and blue light, respectively, and reproduces a color image by projecting the lights on a common screen.

2. Description of the Prior Art

A projection color television receiver set has been known which has a picture tube having a phosphor for emitting red light, a picture tube having a phosphor for emitting green light and a picture tube having a phosphor for emitting blue light and projects images reproduced on face plates of the respective picture tubes onto a screen through projection lenses mounted in front of the respective face plates to reproduce a color image. In such a projection color television receiver set, the three picture tubes are usually arranged horizontally. For example, the picture tube for emitting the green light is arranged at a center and the picture tube for emitting the red light is arranged on one side while the picture tube for emitting the blue light is arranged on the other side. In this type of projection color television receiver set, the face plates of the picture tube for emitting the red light and the picture tube for emitting the blue light arranged on the opposite sides of the picture tube for emitting the green light are arranged obliquely to the screen so that the lights emitted therefrom are projected obliquely to the screen. Consequently, the images reproduced by the blue light and the red light are not reproduced in correct shape although the image reproduced by the picture tube for emitting the green light arranged at the center is reproduced in a relatively correct shape. As shown in FIG. 1, since a face plate 1G1 of a picture tube 1G is arranged in parallel to a screen 4, a rectangular raster (not shown) formed on the face plate 1G1 is enlarged by a lens 2G and projected on the screen 4 as an analogous shape of raster 5G as shown in FIG. 2. The raster on the face plate 1G1 is formed by deflecting electron beams emitted from an electron gun 1G3 by a deflection yoke 1G2. Since face plates 1B1 and 1R1 of picture tubes 1B and 1R are arranged obliquely to the screen 4 by an angle $\theta$, rectangular rasters formed on the face plates 1B1 and 1R1, when they are enlarged by lenses 2B and 2R and projected onto the screen 4, appear as trapezoidal rasters 5B and 5R as shown in FIG. 2. The angle $\theta$ is usually 5–10 degrees. When the picture tube is arranged on the right of the center 0 of the screen 4, the raster formed on the screen 4 is longer on the left hand and shorter on the right hand. When the picture tube is arranged to the left of the center 0 of the screen 4, the raster formed on the screen 4 is longer on the right hand and shorter on the left hand. In the projection color television receiver set, if the shapes of the rasters 5B and 5R are different, a misconvergence results.

In order for the rasters 5B and 5R to be formed in the correct rectangular shape on the screen 4, it is necessary that the rasters of complementary shape to those formed on the face plates 1B1 and 1R1 of the picture tubes 1B and 1R are preformed so that distortions of the rasters 5B and 5R are cancelled. For example, for the raster 5R which emits the red light, a raster 6 shown by a solid line in FIG. 3 must be formed on the face plate 1R. Horizontal lines **7*a* and 7*b* of the raster 6 include trapezoidal distortions and distances $l_1$ and $l_2$ of vertical lines 8*a*, 8*b* and 8*c*** are different, that is, the distance $l_2$ is longer than the distance $l_1$. In the prior art projection color television receiver set, sub-deflection yokes are used to form the trapezoidal rasters on the face plates of the picture tubes and currents are supplied to the sub-deflection yokes from an electrical circuit. The electrical circuit is usually very complex in construction and a characteristic thereof changes as a power supply voltage changes. As a result, the shapes of the rasters formed on the face plates of the picture tubes change and hence the shapes of the rasters reproduced on the screen change, resulting in a misconvergence. In addition, linearity of the reproduced image also changes and a high quality of image is not reproduced on the screen.

SUMMARY OF THE INVENTION

It is an object of the present invention to provide a projection color television receiver set which is free from a misconvergence and a raster distortion and which can form deformed rasters on face plates of picture tubes without requiring an electrical circuit for deforming the rasters formed on the face plates of the picture tubes so that a correct raster is reproduced on a screen.

It is another object of the present invention to provide a deflection yoke for a projection color television receiver set which can form a deformed raster on a face plate of a picture tube.

Electron beams emitted from an electron gun are deflected by a magnetic field generated by currents supplied to deflection windings of a deflection yoke so that a raster is formed on a face plate of the picture tube. Accordingly, when a magnitude or waveform of the current supplied to the deflection windings changes, the magnetic field changes and the shape of the raster changes. When the shape of the deflection windings changes, the shape of the deflection magnetic field changes and the shape of the raster changes. When an auxiliary winding is added to the deflection windings and the deflection magnetic field generated by the deflection winding is changed by a magnetic field generated by the auxiliary winding, the shape of the raster changes. In the present invention, an auxiliary solenoid coil is added to a vertical deflection coil of the deflection yoke. A vertical deflection current is supplied to the auxiliary coil to produce a magnetic field axially of the deflection yoke. This magnetic field deforms the raster. A shape of the vertical deflection coil and a shape of a horizontal deflection coil are also modified such that a distortion of the raster is corrected by magnetic fields generated by the modified vertical and horizontal deflection coils and the magnetic field generated by the auxiliary coil.

DESCRIPTION OF THE PREFERRED EMBODIMENTS

Figure 1:
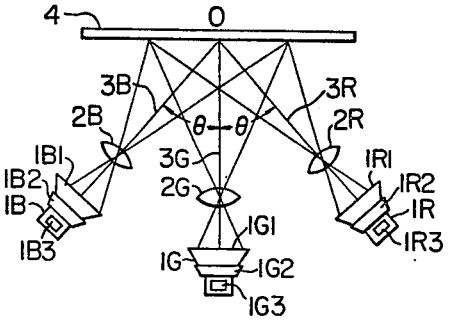
FIG. 1 shows a schematic diagram of a projection color television receiver set.
Figure 2:
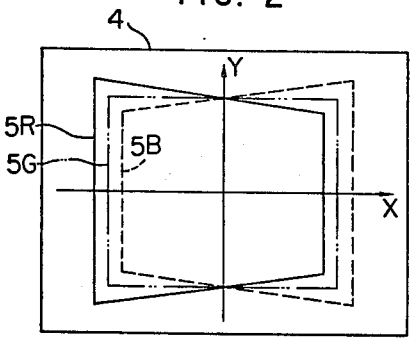
FIG. 2 shows patterns of shapes of rasters reproduced on a screen of the projection color television receiver set.

As described above, in order to correct the trapezoidal distortion and the horizontal linearity of the image reproduced on the screen, it is necessary to form an image having distortions which are vertically and horizontally complementary to those produced on the screen, on the picture tube and project the image on the screen to cancel the distortions. Means for producing the desired trapezoidal distortion and linearity distortion in the image reproduced on the face plate of the picture tube is now explained. In the following description, the function of the picture tube 1R shown in FIG. 1 is explained. The function of the picture tube 1B is symmetric to the function of the picture tube 1R.

Figure 4:
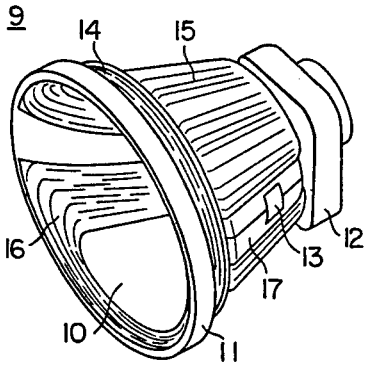
FIG. 4 shows a perspective view of a deflection yoke of the present invention.

FIG. 4 shows a perspective view of a deflection yoke of the present invention. The deflection yoke 9 comprises a horn-shaped core 17, a vertical deflection winding 15 toroidally wound on the core 17, a saddle-shaped horizontal deflection winding 16 arranged within the vertical deflection winding 15, a generally horn-shaped separator 10 arranged between the vertical deflection winding 15 and the horizontal deflection winding 16 and a solenoid-shaped auxiliary coil 14 arranged adjacent to the core 17. Flanges 11 and 12 are integrally formed with the separator 10 to support the horizontal deflection winding 16. A clip 13 holds the core 17.

Figure 5:
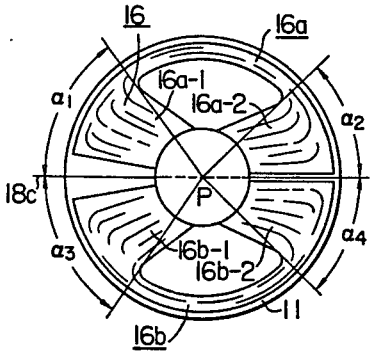
FIG. 5 shows a front view of a horizontal deflection winding of the deflection yoke of the present invention.

FIG. 5 shows a front view of the horizontal deflection winding 16 of the deflection yoke 9 of the present invention. The horizontal deflection winding 16 comprises saddle-shaped horizontal deflection coils 16*a* and 16*b* which are oppositely arranged to each other in symmetric relation to a horizontal plane 18*c* which passes a center axis P of the deflection yoke 9. Winding angles $\alpha_1$ and $\alpha_2$ of side conductors 16*a*-1 and 16*a*-2 of the horizontal deflection coil 16*a* are different from each other with the winding angle $\alpha_1$ being larger than the winding angle $\alpha_2$. Winding angles $\alpha_3$ and $\alpha_4$ of side conductors 16*b*-1 and 16*b*-2 of the horizontal deflection coil 16*b* are different from each other with the winding angle $\alpha_3$ being larger than the winding angle $\alpha_4$. Usually, the winding angles $\alpha_1$ and $\alpha_3$ are equal and the winding angles $\alpha_2$ and $\alpha_4$ are equal. In the present embodiment, the winding angles $\alpha_1$ and $\alpha_3$ are approximately 30 degrees and the winding angles $\alpha_2$ and $\alpha_4$ are approximately 20 degrees.

Figure 6:
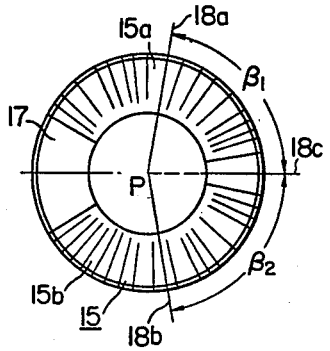
FIG. 6 shows a front view of a vertical deflection winding of the deflection yoke of the present invention.

FIG. 6 shows a front view of the vertical deflection winding 15 of the deflection yoke 9 of the present invention. The vertical deflection winding 15 comprises vertical deflection coils 15*a* and 15*b* toroidally wound on the core 17. The vertical deflection coils 15*a* and 15*b* are oppositely arranged to each other in symmetric relation to the horizontal plane 18*c* which includes the center axis P of the deflection yoke 9 with a center line 18*a* of the vertical deflection coil 15*a* and a center line 18*b* intersecting the horizontal plane 18*c* at an angle $\beta_1$ and a center line 18*b* of the vertical deflection coil 15*b* intersecting the horizontal plane 18*c* at an angle $\beta_2$. The angles $\beta_1$ and $\beta_2$ are usually smaller than 90 degrees and the angles $\beta_1$ and $\beta_2$ are usually equal. In the present embodiment, the angles $\beta_1$ and $\beta_2$ are approximately 67 degrees.

Figure 7:
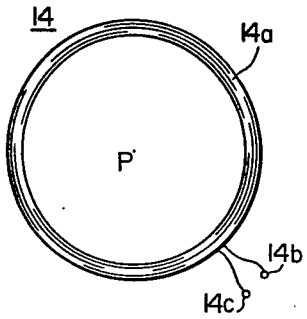
FIG. 7 shows a front view of an auxiliary coil used in the deflection yoke of the present invention.

FIG. 7 shows a front view of the auxiliary coil 14 of the deflection yoke 9 of the present invention. The auxiliary coil 14 comprises a solenoid-shaped winding 14*a* which is connected to the vertical deflection coil 15*a* or 15*b* in parallel or series through terminals 14*b* and 14*c* so that a vertical deflection coil flows through the auxiliary coil 14. The auxiliary coil 14 has approximately 500 turns of the winding 14*a*. The auxiliary coil 14 is arranged such that a center P thereof coincides with a center P of the horizontal deflection winding 16, the vertical deflection winding 15 or the core 17.

Figure 8:
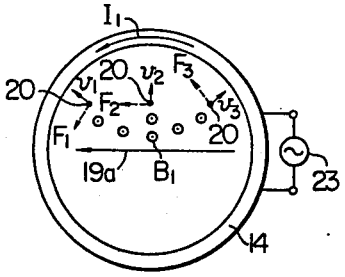
FIGS. 8 and 9 show diagrams for explaining a function of the auxiliary coil.
Figure 9:
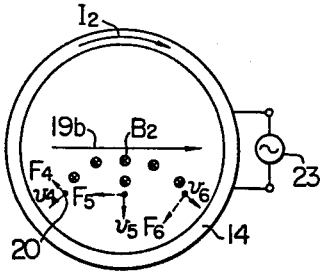
Figure 10:
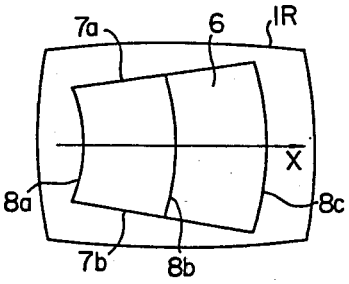
FIG. 10 shows a pattern of a shape of a raster deformed by a magnetic field generated by the auxiliary coil.

The functions of the auxiliary coil 14, the vertical deflection winding 15 and the horizontal deflection winding 16 are now explained. The auxiliary coil 14 of the deflection yoke 9 of the present invention is wound in the solenoid-shape and arranged adjacent to the vertical deflection winding 15 with the centers P thereof being coincident. Accordingly, when a current flows in the auxiliary coil 14, a magnetic field parallel to the center axis of the deflection yoke, that is, a magnetic field perpendicular to the face plate of the picture tube is generated. As shown in FIG. 8, the auxiliary coil 14 is connected to the vertical deflection coils 15*a* and 15*b*. When the vertical deflection magnetic field 19*a* is directed to the left and an electron beam 20 is deflected to the top of the picture tube, a magnetic field $B_1$ directed to the face plate of the picture tube is generated by a current $I_1$ as shown in FIG. 8, and when the vertical deflection magnetic field 19*b* is directed to the right and the electron beam 20 is deflected to the bottom of the picture tube, a magnetic field $B_2$ directed to an electron gun is generated by a current $I_2$, as shown in FIG. 9. When the electron beam 20 is deflected to the top of the picture tube by the vertical deflection magnetic field 19*a* and horizontally deflected by the horizontal deflection magnetic field, the electron beam 20 is imported with velocity components $v_1$, $v_2$ and $v_3$ as shown in FIG. 8. Accordingly, the electron beam 20 is acted upon by forces $F_1$, $F_2$ and $F_3$ by the magnetic field $B_1$ and deflected in the directions of the forces $F_1$, $F_2$ and $F_3$. When the electron beam 20 is deflected to the bottom of the picture tube by the vertical deflection magnetic field 19*b* and horizontally deflected by the horizontal deflection magnetic field, the electron beam 20 is imported with velocity components $v_4$, $v_5$ and $v_6$ as shown in FIG. 9. Accordingly, the electron beam 20 is acted upon by forces $F_4$, $F_5$ and $F_6$ by the magnetic field $B_2$ and deflected in the directions of the forces $F_4$, $F_5$ and $F_6$. FIG. 10 shows a raster 6 deformed by the current flowing through the auxiliary coil 14. A horizontal line 7*a* at the top of the raster 6 rises as it goes to the right and a horizontal line 7*b* at the bottom falls as it goes to the right, and the raster 6 is of generally trapezoidal shape. Vertical lines 8*a*, 8*b* and 8*c* of the raster 6 are convexed in the direction of x-axis.

Figure 11:
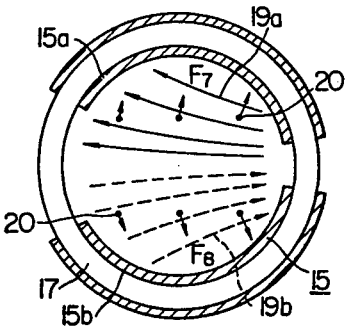
FIG. 11 shows a diagram for explaining a function of the vertical deflection winding of the deflection yoke of the present invention.
Figure 12:
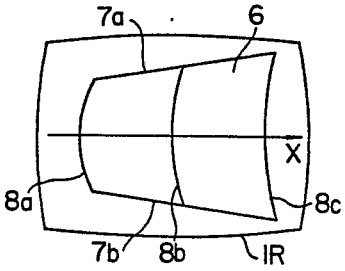
FIG. 12 shows a pattern of a shape of a raster deformed by a magnetic field generated by the vertical deflection winding.
Figure 13:
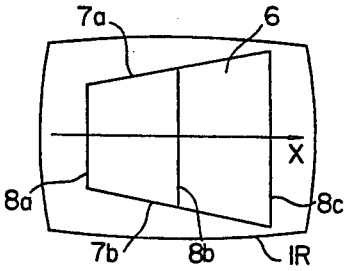
FIG. 13 shows a pattern of a shape of a raster deformed by the magnetic fields generated by the auxiliary coil and the vertical deflection winding.

Since the center axes 18*a* and 18*b* of the vertical deflection coils 15*a* and 15*b* of the vertical deflection winding 15 are not normal to the axis of symmetry 18*c*, the magnetic field generated by the vertical deflection coils 15*a* and 15*b* is deformed and nonuniform. FIG. 11 shows a shape of the magnetic field generated by the currents flowing through the vertical deflection coils 15*a* and 15*b*. In FIG. 11, for the sake of convenience, the vertical deflection magnetic field 19*a* for upwardly deflecting the electron beam 20 and the vertical deflection magnetic field 19*b* for downwardly deflecting the electron beam 20 are shown in the same figure. Since the vertical deflection coils 15*a* and 15*b* are asymmetrically arranged, the vertical deflection magnetic fields 19*a* and 19*b* are dense on the right and coarse in the left. The electron beam 20 is acted by forces $F_7$ and $F_8$ which are normal to lines of magnetic forces 19*a* and 19*b*. Each of the forces $F_7$ and $F_8$ each has a vertical component and a horizontal component. Accordingly, the electron beam 20 is deflected vertically by the vertical deflection magnetic fields 19*a* and 19*b* and also deflected rightwardly. Since the vertical deflection magnetic fields 19*a* and 19*b* are dense on the right, the electron beam 20 is deflected more on the right. FIG. 12 shows a raster deflected by the currents flowing through the vertical deflection coils 15*a* and 15*b*. The horizontal line 7*a* of the raster 6 rises as it goes to the right and the horizontal line 7*b* falls as it goes to the right. The vertical lines 8*a*, 8*b* and 8*c* of the raster 6 are convexed in the direction of the x-axis. Accordingly, when the auxiliary coil 14 and the vertical deflection winding 15 shown in FIG. 7 are used in combination, the arc-shaped distortions of the vertical lines 8*a*, 8*b* and 8*c* of the raster 6 are cancelled out by each other to produce straight lines as shown in FIG. 13. The slopes of the horizontal lines 7*a* and 7*b* of the raster 6 are emphasized so that the raster 6 is rendered generally trapezoidal.

Figure 14:
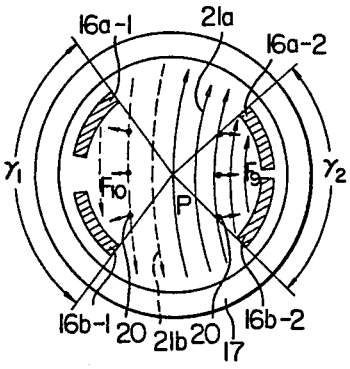
FIG. 14 shows a diagram for explaining a function of the horizontal deflection winding of the deflection yoke of the present invention.
Figure 15:
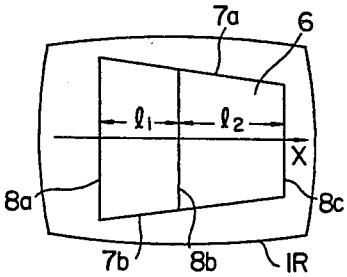
FIG. 15 shows a pattern of a shape of a raster deformed by a magnetic field generated by the horizontal deflection winding.

As described above, in the horizontal deflection winding 16 of the deflection yoke of the present invention, the winding angles $\alpha_1$ and $\alpha_3$ of the side conductors 16*a*-1 and 16*b*-1 are different from the winding angles $\alpha_2$ and $\alpha_4$ of the side conductors 16*a*-2 and 16*b*-2 and hence an overall winding angle $\gamma_1(\alpha_1+\alpha_3)$ of the side conductors 16*a*-1 and 16*b*-1 is different from an overall winding angle $\gamma_2(\alpha_2+\alpha_4)$ of the side conductors 16*a*-2 and 16*b*-2. Accordingly, the magnetic fields generated by the currents flowing through the side conductors 16*a*-1, 16*a*-2, 16*b*-1 and 16*b*-2 are deformed. FIG. 14 shows the shape of the horizontal deflection magnetic fields generated by the currents flowing through the side conductors 16*a*-1, 16*a*-2, 16*b*-1 and 16*b*-2 of the horizontal deflection coils 16*a* and 16*b*. A magnetic field 21*a* shown by a solid line deflects the electron beam 20 rightward and a magnetic field 21*b* shown by a broken line deflect the electron beam 20 leftward. In FIG. 14, for the sake of convenience, the horizontal deflection magnetic field 21*a* and the horizontal deflection magnetic field 21*b* are shown in the same figure. Since the winding angle $\gamma_1$ of the side conductors 16*a*-1 and 16*b*-1 is different from the winding angle $\gamma_2$ of the side conductors 16*a*-2 and 16*b*-2, the magnetic fields 21*a* and 21*b* are dense on the sides of the side conductors 16*a*-2 and 16*b*-2 and convex toward the side conductors 16*a*-1 and 16*b*-1. Accordingly, when the electron beam 20 is deflected rightward by the horizontal deflection magnetic field 21*a* shown by the solid line, the electron beam 20 is strongly deflected rightward by the force Fa and deflected downward on the side of the side conductor 16*a*-2 and upward on the side of the side conductor 16*b*-2. When the electron beam 20 is deflected leftward by the horizontal deflection magnetic field 21*b* shown by the broken line, the electron beam 20 is weakly deflected leftward by the force $F_{10}$ and deflected upward on the side of the side conductor 16*a*-1 and downward on the side of the side conductor 16*b*-1. FIG. 15 shows a raster deflected by the currents flowing through the side conductors 16*a*-1, 16*a*-2, 16*b*-1 and 16*b*-2 of the horizontal deflection coils 16*a* and 16*b*. The horizontal line 7*a* at the top of the raster 6 falls as it goes to the right and the horizontal line 7*b* at the bottom of the raster 6 rises as it goes to the right. The vertical lines 8*a*, 8*b* and 8*c* of the raster 6 are substantially straight but the distance $l_1$ between the vertical lines 8*a* and 8*b* is smaller than the distance $l_2$ between the vertical lines 8*b* and 8*c* because the vertical line 8*a* is weakly horizontally deflected while the vertical line 8*c* is strongly horizontally deflected. Thus, the raster 6 is of generally trapezoidal shape with nonuniform horizontal linearity. This nonuniform horizontal linearity is, of course, desirable.

Figure 3:
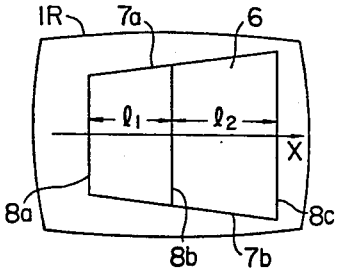
FIG. 3 shows a pattern of a shape of a raster to be reproduced on a face plate of a picture tube.

When the auxiliary coil 14, the vertical deflection winding 15 and the horizontal deflection winding 16 are used in combination, the slopes of the horizontal lines 7*a* and 7*b* of the raster 6 shown in FIG. 15 are reversed by the affect of the vertical deflection magnetic fields 19*a* and 19*b* and the magnetic fields $B_1$ and $B_2$ generated by the auxiliary coil 14 so that the horizontal line 7*a* rises and the horizontal line 7*b* falls as they go to the right. Since the vertical lines 8*a*, 8*b* and 8*c* are little affected by the vertical deflection magnetic fields 19*a* and 19*b* and the magnetic fields $B_1$ and $B_2$ generated by the auxiliary coil 14, the distance $l_1$ between the vertical lines 8*a* and 8*b* and the distance between the vertical lines 8*b* and 8*c* are kept substantially unchanged as shown in FIG. 15. Accordingly, when the auxiliary coil 14, the vertical deflection winding 15 and the horizontal deflection winding 16 are used in combination, the desired raster 6 shown by the solid line in FIG. 3 is formed. It should be understood that the number of turns of the winding 14*a* of the auxiliary coil 14, the intersection angles $\beta_1$ and $\beta_2$ between the center axes 18*a* and 18*b* of the vertical deflection winding 15 and the axis of symmetry 18*c* and the winding angles $\alpha_1$, $\alpha_2$, $\alpha_3$ and $\alpha_4$ of the side conductors 16a-1, 16a-2, 16b-1 and 16b-2 of the horizontal deflection winding 16 are appropriately selected to form the desired shape of the raster 6.

Figure 16:
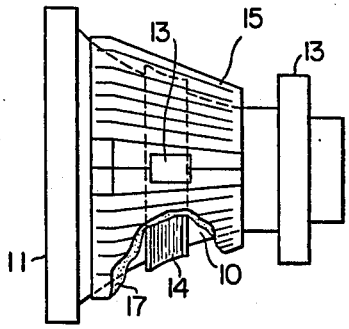
FIGS. 16 and 17 show side elevational views of second and third embodiments of the deflection yoke of the present invention.
Figure 17:
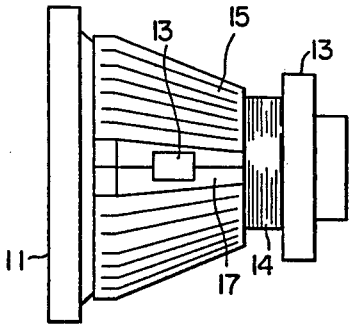

FIGS. 16 and 17 shown second and third embodiments of the deflection yoke of the present invention. In the second embodiment shown in FIG. 16, the auxiliary coil 14 is arranged along the inner wall of the core 17, and in the third embodiment shown in FIG. 17, the auxiliary coil 14 is arranged between the core 17 and the flange 13. In the second and third embodiments, the number of turns of the auxiliary coil 14 is appropriately selected to form the desired shape of the raster 6.

Figure 18:
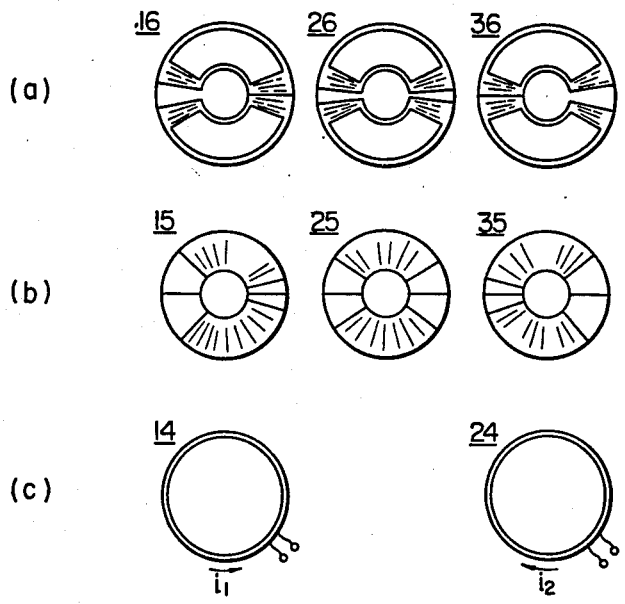
FIG. 18 shows a front view of a combination of the horizontal deflection winding, the vertical deflection winding and the auxiliary coil.

FIG. 18 shows a deflection yoke used in the projection color television receiver set. The horizontal deflection winding 16, the vertical deflection winding 15 and the auxiliary coil 14 are used for the picture tube 1R shown in FIG. 1, a horizontal deflection winding 26 and a vertical deflection winding 25 are used for the picture tube 1G and a horizontal deflection winding 36, a vertical deflection winding 35 and an auxiliary coil 24 are used for the picture tube 1B. The horizontal deflection winding 16, the vertical deflection winding 15 and the auxiliary coil 14 are identical to those shown in FIGS. 5, 6 and 7. Since the raster reproduced on the face plate 1G1 of the picture tube 1G is not to be distorted, the horizontal deflection winding 26 and the vertical deflection winding 25 used for the picture tube 1G are not deformed and the deflection yoke used for the picture tube 1G does not include the auxiliary coil. Since the raster reproduced on the face plate 1B1 of the picture tube 1B should have a complementary distortion to that of the raster reproduced on the face plate 1R1 of the picture tube 1R, the horizontal deflection winding 36 used for the picture tube 1B is complementarily formed to the horizontal deflection winding 16 and the vertical deflection winding 35 is complementarily formed to the vertical deflection winding 15. The auxiliary coil 14 and the auxiliary coil 24 are of the shape but the auxiliary coil 24 is connected such that a current $i_2$ flows therethrough in opposite direction to a current $i_1$ flowing through the auxiliary coil 14.

Figure 19:
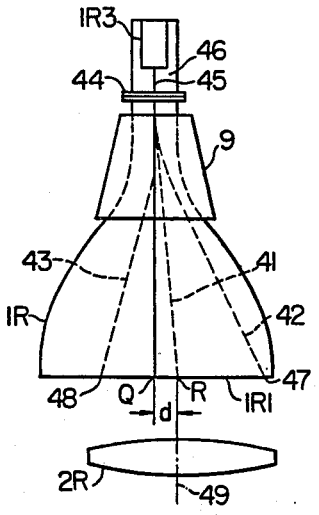
FIG. 19 shows a diagram of a picture tube having the deflection yoke of the present invention mounted thereon and having a beam bender.
Figure 20:
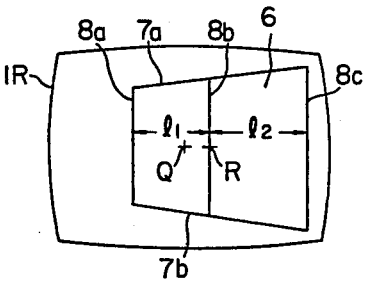
FIG. 20 shows a pattern of a shape of a raster deformed by the beam bender.

While the auxiliary coils for sloping the horizontal lines of the raster have been described above, auxiliary coils through which the horizontal deflection current flows may be used to slope the vertical lines of the raster.

Where the distortion is not fully corrected by the deflection yoke of the present invention, the following auxiliary means may be used. In most cases, the trapezoidal distortion and the linearity of the raster are fully corrected by the deflection yoke of the present invention. However, in some cases, the linearity of the raster is not fully corrected. FIG. 19 shows the auxiliary means for correcting the linearity of the raster. FIG. 19 is shown in connection with the picture tube for emitting the red light shown in FIG. 1. In the picture tube 1R having the deflection yoke 9 of the present invention mounted thereon, if the linearity is not fully nonuniform, a beam bender 44 is mounted on a neck 46 of the picture tube 1R. The beam bender 44 is a magnet which bends the direction of movement of an electron beam 45 emitted from the electron gun 1R3 by a predetermined angle when no deflection current flows through the deflection yoke 9, the electron beam 45 is bent by the beam bender 44 to form an electron beam 41, which does not reach a center Q of the face plate 1R1 of the picture tube 1R but reaches a point R which is displaced by a distance d from the center Q. When the current flows through the deflection yoke 9, the electron beam 45 is deflected. Broken lines 42 and 43 indicate the deflected electron beams. The electron beams 42 and 43 are also bent by the beam bender 44 as the electron beam 41 is done. Accordingly, a position 47 at which the electron beam reaches on the face plate 1R1 is farther from the center Q and a point 48 at which the electron beam 43 reaches on the face plate 1R1 is nearer to the center Q. The locus length of the electron beam 42 is longer than the locus length of the electron beam 43. Accordingly, as is well known, the reaching point 47 of the electron beam 42 on the face plate 1R1 is farther from the point R and the reaching point 48 of the electron beam 43 on the face plate 1R1 is nearer to the point R. FIG. 20 shows a shape of a raster formed by the electron beams bent by the beam bender 44. FIG. 20 shows the shape of the raster 6 formed only by the action of the beam bender 44, and the deformation of the raster caused by the action of the deflection yoke 9 is not shown therein. Since the electron beam 45 is bent by the beam bender 44, the vertical line 8b of the raster 6 does not pass through the center Q but passes through the point R. The horizontal line 7a at the top of the raster 6 rises as it goes to the right and the horizontal line 7b at the bottom of the raster 6 falls as it goes to the right. The distance $l_1$ between the vertical lines 8a and 8b is short and the distance $l_2$ between the vertical lines 8b and 8c is long. Accordingly, when the beam bender 44 is used, the distance $l_1$ between the vertical lines 8a and 8b of the raster 6 and the distance $l_2$ between the vertical lines 8b and 8c, that is, the horizontal linearity is changed, and the slopes of the horizontal lines 7a and 7b of the raster 6 are opposite to the slopes of the horizontal lines 7a and 7b of the raster 6 formed by the horizontal deflection winding 16. Accordingly, when the beam bender 44 is used to appropriately bend the electron beam 45, the horizontal linearity of the raster 6 is adjusted. When the beam bender 44 is used for the picture tube 1R, it is advisable to arrange the lens 2R such that a center axis 49 thereof passes through the point R on the face plate 1R1 of the picture tube 1R. When the lens 2R is arranged in this manner, the distortion of the raster 6 caused by the lens 2 is small.

While the beam bender 44 used for the picture tube 1R has been described, a beam bender may be used for the picture tube 1B as required.

What is claimed is:

1. A deflection yoke for a picture tube of a projection color television receiver set, comprising:

(1) a generally horn-shaped core;

(2) a vertical deflection winding toroidally wound on said core;

(3) a saddle-shaped horizontal deflection winding arranged in said core;

(4) a generally horn-shaped separator arranged between said vertical deflection winding and said horizontal deflection winding; and (5) a solenoid-shaped auxiliary coil having a center axis thereof substantially aligned to a center axis of said core and arranged adjacent to said vertical deflection winding, said auxiliary coil being electrically connected to said vertical deflection winding to receive a vertical deflection current thereto.

2. A deflection yoke according to claim 1, wherein said vertical deflection winding includes first and second vertical deflection coils arranged symmetrically to a horizontal plane including the center axis of said deflection yoke, center lines of said first and second vertical deflection coils intersecting said horizontal plane at a substantially equal angle other than a right angle.

3. A deflection yoke according to claim 1, wherein said horizontal deflection winding includes first and second horizontal deflection coils arranged symmetrically to a horizontal plane including the center axis of said deflection yoke, said first horizontal deflection coil having first and second side conductors, said second horizontal deflection coil having third and fourth side conductors, said first side conductor and said third side conductor being arranged oppositely to each other, said second side conductor and said fourth side conductor being arranged oppositely to each other, winding angles of said first and third side conductors being substantially equal, winding angles of said second and fourth side conductors being substantially equal, the winding angles of said first and third side conductors being different from the winding angles of said second and fourth side conductors.

4. A deflection yoke for a picture tube of a color television receiver wherein the picture tube includes electron beam means for generating an electron beam and for forming a raster on a face plate of the picture tube, the deflection yoke comprising:

a generally horn-shaped core;

a vertical deflection coil means having a winding toroidally wound on the core for deflecting the electron beam in a vertical direction in response to an electrical current passing therethrough;

a horizontal deflection coil means having a saddle-shaped winding arranged in the core for deflecting the electron beam in a horizontal direction in response to an electrical current passing therethrough;

a generally horn-shaped separator arranged between the vertical deflection winding and the horizontal deflection winding; and solenoid-shaped auxiliary coil means having a center axis thereof substantially aligned to a center axis of the core, the auxiliary coil means being electrically connected with one of the vertical deflection coil means and the horizontal deflection coil means for receiving the current passing through the one of the vertical deflection coil means and the horizontal deflection coil means for deforming the raster formed on the face plate of the picture tube.

5. A deflection yoke according to claim 4, wherein the solenoid-shaped auxiliary coil means is electrically connected with the vertical deflection coil means for receiving the vertical deflection current passing therethrough.

6. A deflection yoke according to claim 4, wherein the solenoid-shaped auxiliary coil means is electrically connected with the horizontal deflection coil means for receiving the horizontal deflection current therethrough.

7. A deflection yoke according to claim 4, wherein the color television receiver is a projection color television receiver set having three color picture tubes horizontally arranged, the deflection yoke being provided in the outer picture tubes of the horizontal arrangement.

8. A deflection yoke according to claim 4, wherein the picture tube further includes beam bender means for bending the electron beam when no deflection current flows through the deflection yoke.

9. A deflection yoke according to claim 4, wherein the vertical deflection winding includes first and second vertical deflection coils arranged symmetrically to a horizontal plane including the center axis of said deflection yoke, center lines of the first and second vertical deflection coils intersecting said horizontal plane at a substantially equal angle other than a right angle.

10. A deflection yoke according to claim 4, wherein the horizontal deflection winding includes first and second horizontal deflection coils arranged symmetrically to a horizontal plane including the center axis of the deflection yoke, the first horizontal deflection coil having first and second side conductors, the second horizontal deflection coil having third and fourth side conductors, the first side conductor and the third side conductor being arranged oppositely to each other, the second side side conductor and the fourth side conductor being arranged oppositely to each other, winding angles of the first and third side conductors being substantially equal, winding angles of the second and fourth side conductors being substantially equal, the winding angles of the first and third side conductors being different from the winding angles of the second and fourth side conductors.

* * * * *